US005895285A

United States Patent [19]

Okabe

[11] Patent Number: 5,895,285

[45] Date of Patent: Apr. 20, 1999

[54] PRESS-CONTACT TYPE CONNECTOR

[75] Inventor: Toshiaki Okabe, Shizuoka, Japan

[73] Assignee: Yazaki Corporation, Tokyo, Japan, JPX

[21] Appl. No.: 09/052,101

[22] Filed: Mar. 31, 1998

[30] Foreign Application Priority Data

Apr. 7, 1997 [JP] Japan ..... 9-088189

[51] Int. Cl.[6] ..... H01R 4/24

[52] U.S. Cl. ..... 439/400; 439/404

[58] Field of Search ..... 439/400, 404, 439/417, 596, 862

[56] References Cited

U.S. PATENT DOCUMENTS

| | | | |
|---|---|---|---|
| 4,822,297 | 4/1989 | Prince et al. | 439/862 |
| 5,122,077 | 6/1992 | Maejima et al. | 439/398 |
| 5,573,430 | 11/1996 | Hatagishi | 439/400 |
| 5,746,628 | 5/1998 | Yamamoto | 439/862 |

FOREIGN PATENT DOCUMENTS 59-63967 4/1984 Japan .

*Primary Examiner*—Gary Paumen
*Assistant Examiner*—Antoine Ngandjui
*Attorney, Agent, or Firm*—Sughrue, Mion, Zinn, Macpeak & Seas, PLLC

[57] ABSTRACT

A press-contact type connector comprises: a connector housing 11 having terminal accommodating chambers 15 which accommodate press-contact terminals 25, and openings 16 provided for pressing wires against the press-contact terminals in the terminal accommodating chambers.and covers 12 and 13 which, after the wires have been pressed against the press-contact terminals in the terminal accommodating chambers, ares engaged with the connector housing in such a manner as to close the openings. In the connector, the covers 12 and 13 have flexible bands 17 which, when the covers are engaged with the connector housing, press the wires, which are pressed against the press-contact terminals 25, in the direction of press-contact.

7 Claims, 6 Drawing Sheets

PRESS-CONTACT TYPE CONNECTOR

BACKGROUND OF THE INVENTION

1. Field of the Invention

This invention relates to a press-contact type connector.

2. Related Art

FIG. 5 shows a press-contact type connector disclosed by Japanese Unexamined Utility Model Publication No. 63967/1984. The press-contact type connector comprises a connector housing 1, and a cover 2. In the connector housing 1, terminal accommodating chambers 3 adapted to accommodate press-type terminals 5 are juxtaposed; and in the rear half of the upper surface, openings 4 are formed to expose the rear halves of all the terminal accommodating chamber 3. On the other hand, the cover 2 is combined with the connector housing 1 to close (cover) the openings 4, and has wire pressing protrusions 7 and 8 inside.

The press-type connector is assembled as follows: First, press-type terminals 5 are set in the terminal accommodating chambers 3 of the connector housing 1, and wires W are press-connected to the press type terminals 5 by using the openings 4. As a result, the protrusions 7 and 8 are pressed against the press type terminals to push the wires W downwardly, thereby to prevent the removal of the wires W from the press slots. Hence, in the case where the connector is mounted on an automobile, the connection of the wires is maintained unchanged even when the connector is vibrated.

As was described above, in the connector, the wires are fixedly pressed by the protrusions 7 and 8 which are fixedly provided on the inner surface of the cover 2. However, in the case where the size of wires to be used is smaller than the specified wire size, the wires cannot be sufficiently pressed by the protrusions; that is, the wires may be removed from the press slots. On the other hand, in the case where the size of wires to be used is larger than the specified wire size, it may be difficult to lock the cover 2 to the connector housing 1.

SUMMARY OF THE INVENTION

In view of the foregoing, an object of the invention is to provide a press-contact type connector in which, even when the size of wires to be used is different from the specified wire size, the removal of the wires is prevented with a press force applied thereto, and the cover can be engaged with the connector housing with ease. According to the present invention, a press-contact type connector comprising: a connector housing having:

terminal accommodating chambers which accommodate press-contact terminals;

openings provided for pressing wires against the press-contact terminals in the terminal accommodating chambers; and a cover which, after the wires have been pressed against the press-contact terminal in the terminal accommodating chambers, is engaged with the connector housing in such a manner as to close the openings, in which, according to the invention, the cover has flexible pieces which, when the cover is engaged with the connector housing, press the wires, which are pressed against the press-contact terminals, in the direction of press-contact.

In the press-contact type connector of the present invention, the flexible pieces press the wires while being elastically deformed. Hence, independently of the diameter of wires, the wires can be positively pressed; that is, the removal of the wires from the press-contact slots can be prevented.

According to the present invention, the cover and the connector housing are coupled to each other with flexible bands serving as the flexible pieces, and the length of each of the flexible bands is so determined that, when the cover is engaged with the connector housing, the middle portion of the flexible band as viewed in the direction of length is bent or deformed to press the respective wire.

With the press-contact type connector, when the cover is engaged with the connector housing, the middle portion of each of the flexible bands adapted to couple the cover to the connector housing are bent (or deformed) to Press the respective wire thereby to prevent the removal of the wire from the press-contact slot.

According to the invention, the openings are provided in the rear half portion of the connector housing, first ends of the flexible bands are coupled to the front ends of the openings, while the remaining second ends of the flexible bands are coupled to the inner surface of the rear end portion of the cover, and the length of each of the flexible bands is longer than the straight distance between both coupling sections which is obtained when the cover is engaged with the connector housing.

With the press-contact type connector, the front ends of the openings are coupled to the rear end portion of the cover with the flexible bands. Hence, the cover is engaged with the connector housing by parallel-moving the cover backwardly from the front standby position, so that the openings are closed thereby. Under this condition, the middle portion of each of the flexible bands is bent or deformed to prevent the removal of the wires from the press-contact slots.

According to the invention, locking protrusions are provided on the inner surface of the cover to prevent the backward movement of the press-contact terminals, and the second ends of the flexible bands are coupled to the locking protrusions.

With the press-contact type connector, the locking protrusions coupled to the second ends of the flexible bands prevents the backward movement of the press-contact terminals; thus holding the positions of the press-contact terminals correctly.

BRIEF DESCRIPTION OF THE DRAWINGS

FIG. 4(*b*) is an enlarged diagram of the press-contact type connector to which a heavy wire is press-connected.

DETAILED DESCRIPTION OF THE PREFERRED EMBODIMENT

A preferred embodiment of the invention will be described with reference to the accompanying drawings.

Figure 1:
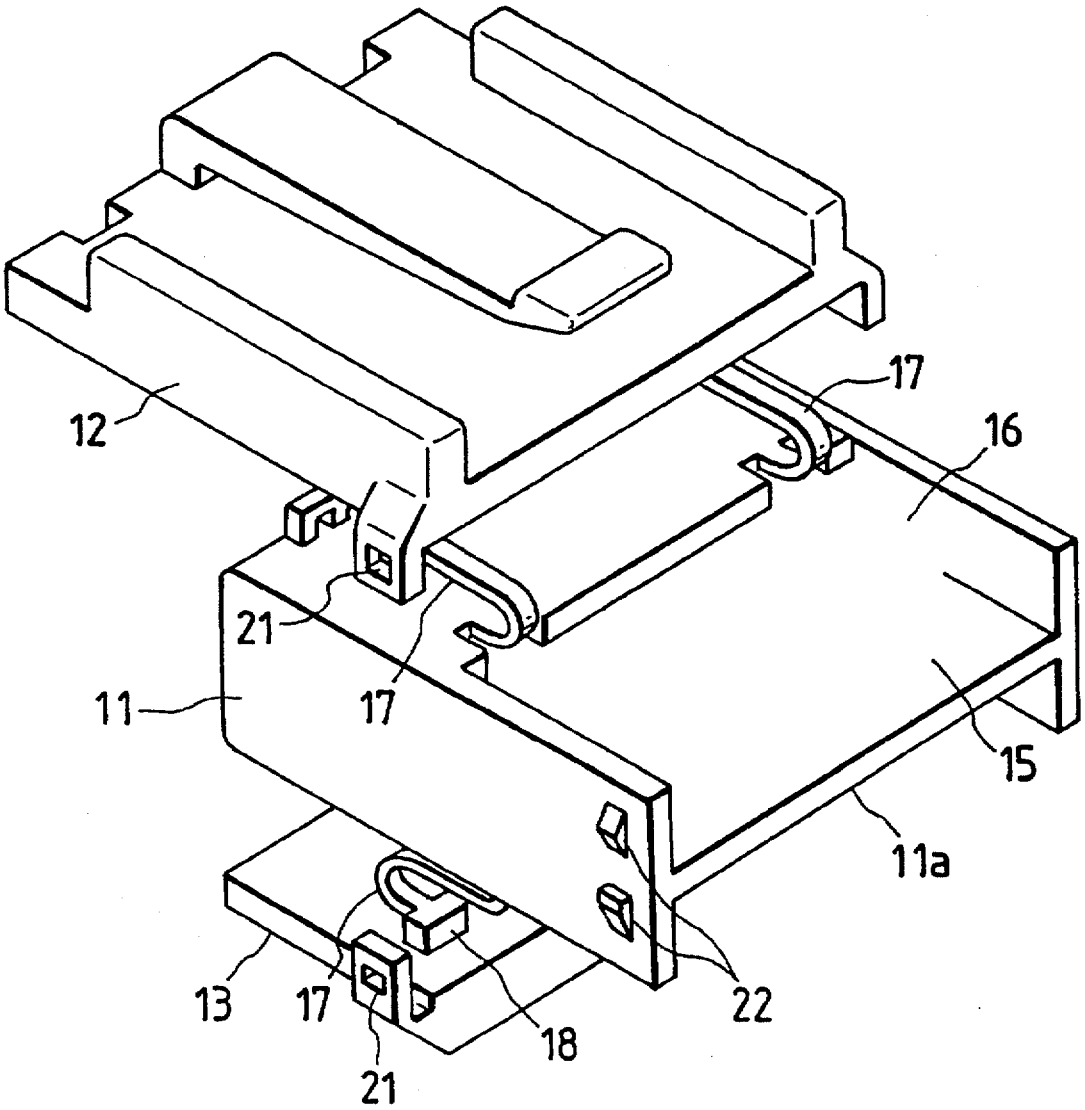
FIGS. 1 and 2 are a perspective view, and a sectional view, respectively, showing a press-contact type connector, an embodiment of the invention, in which cover are not engaged with a connector housing.
Figure 2:
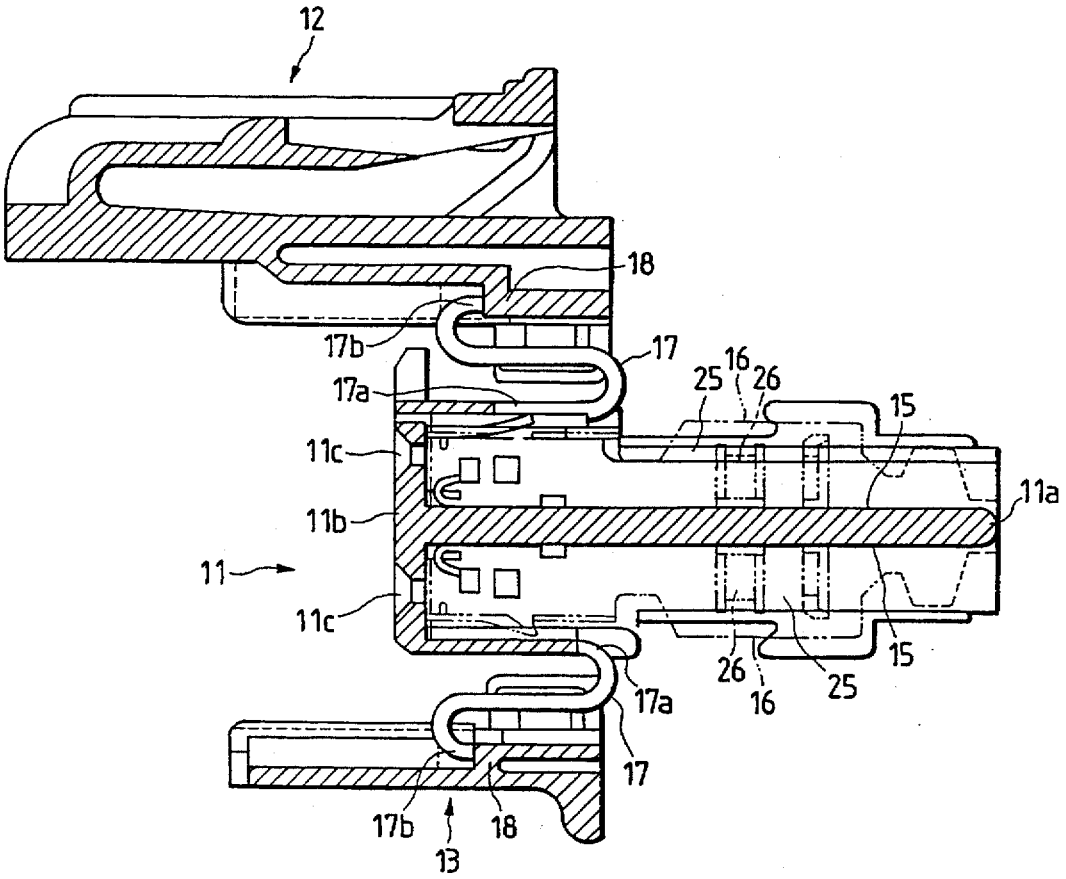
Figure 3:
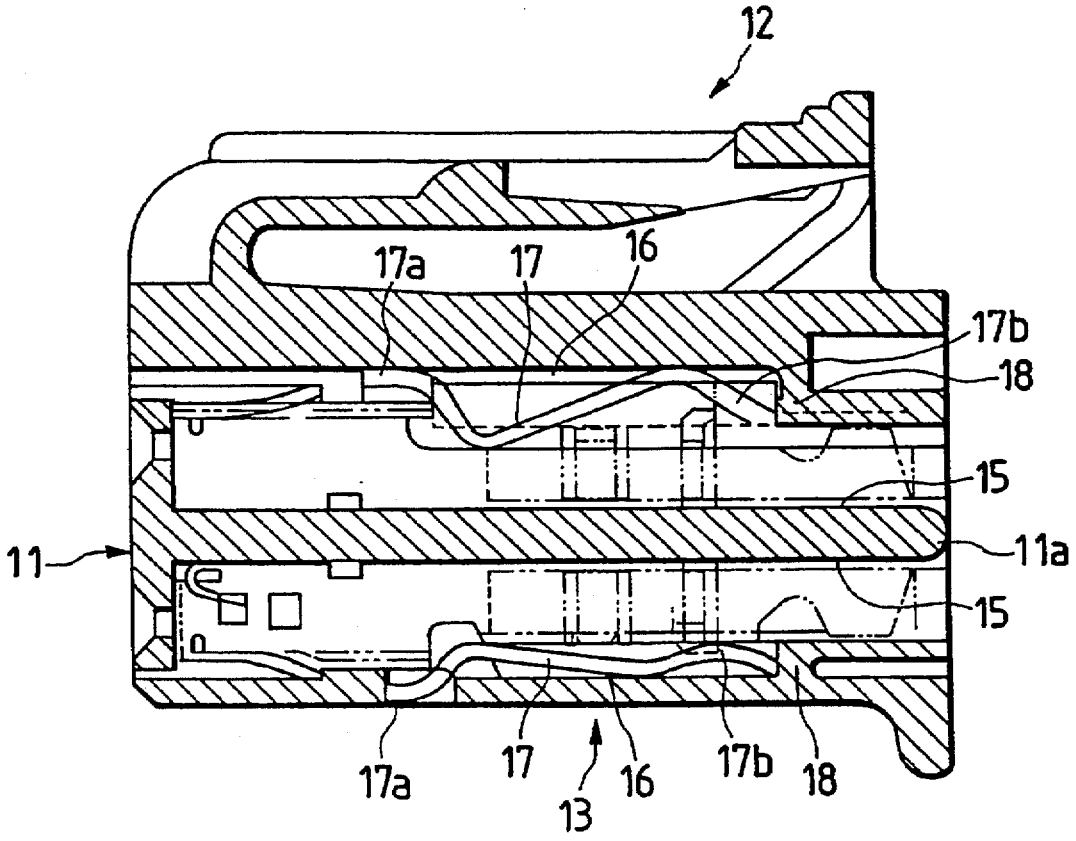
FIG. 3. is a sectional view showing the press-contact type connector in which the covers have been engaged with the connector housing.
Figure 4A:
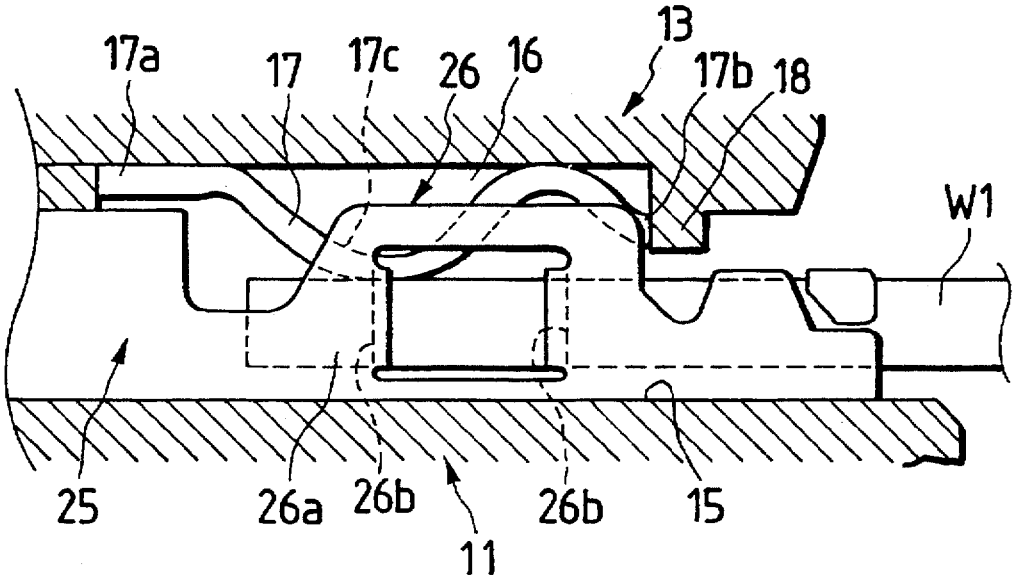
FIGS. 4(*a*) and 4(*b*) are enlarged diagrams for a description of the function of the embodiment. More specifically, FIG. 4(*a*)is an enlarged diagram of the press-contact type connector to which a thin wire is press-connected.
Figure 4B:
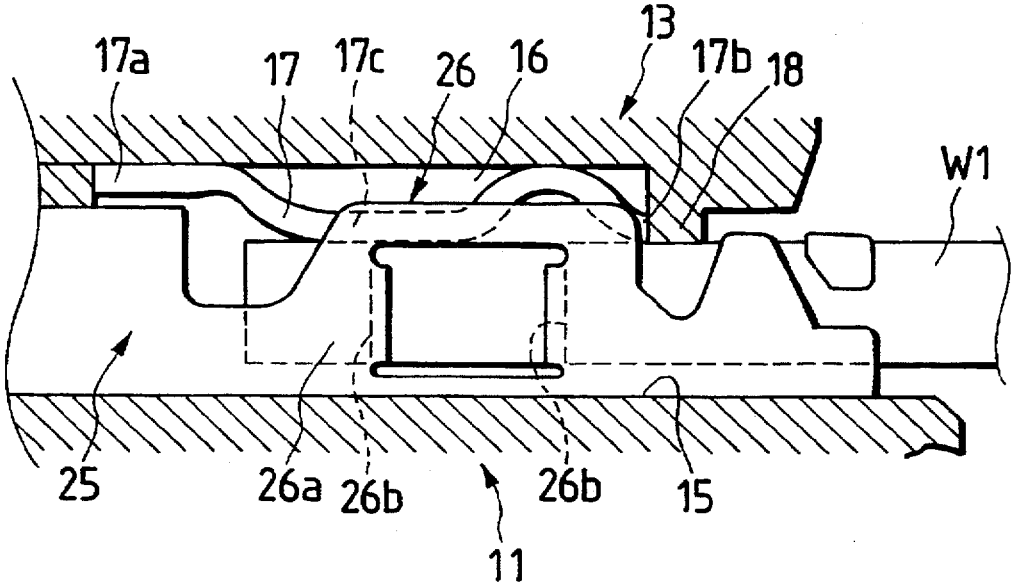
Figure 5:
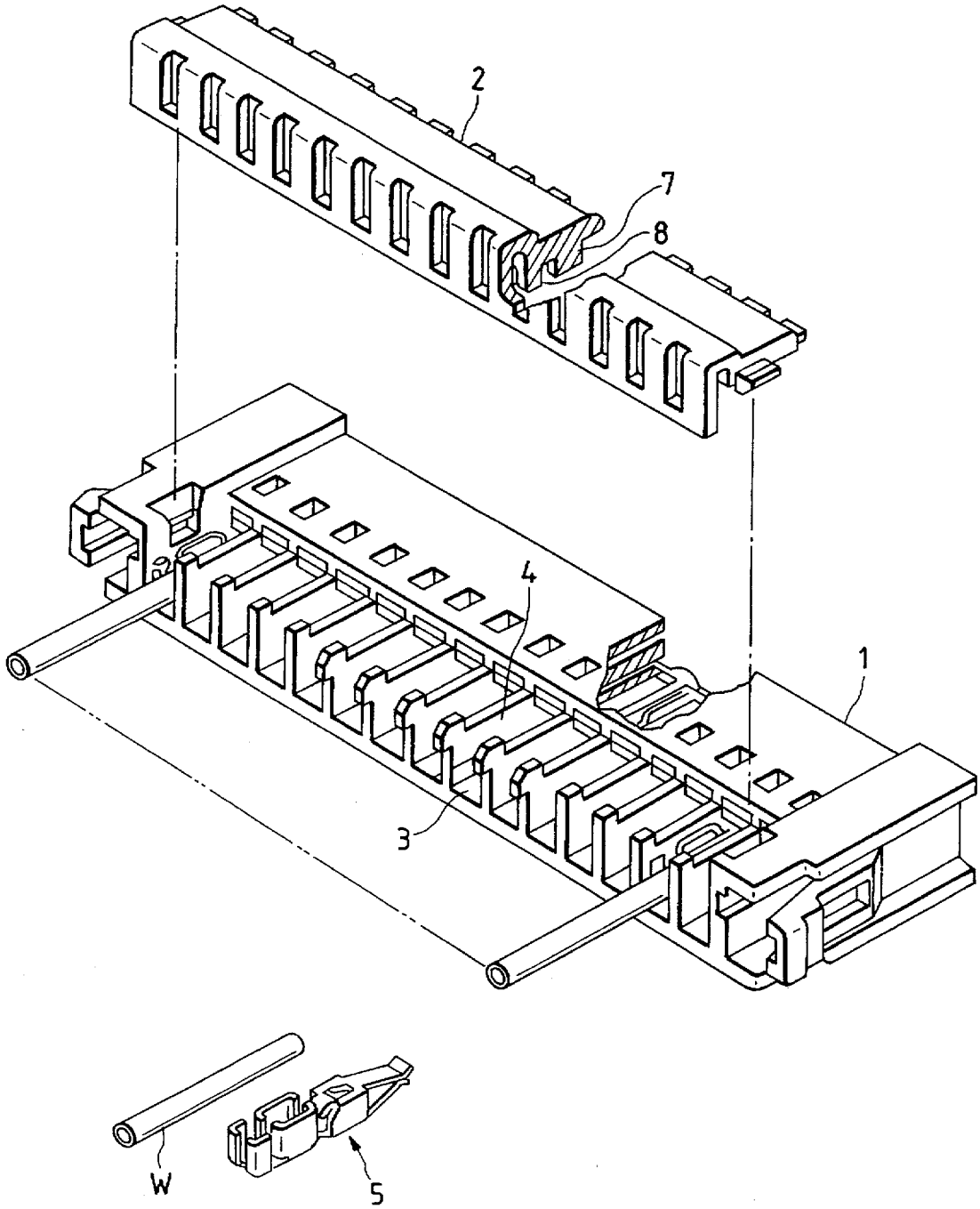
FIG. 5 PRIOR ART
FIGS. 5 and 6 are a perspective view and a sectional view, respectively, showing a conventional press-contact type connector.
Figure 6:
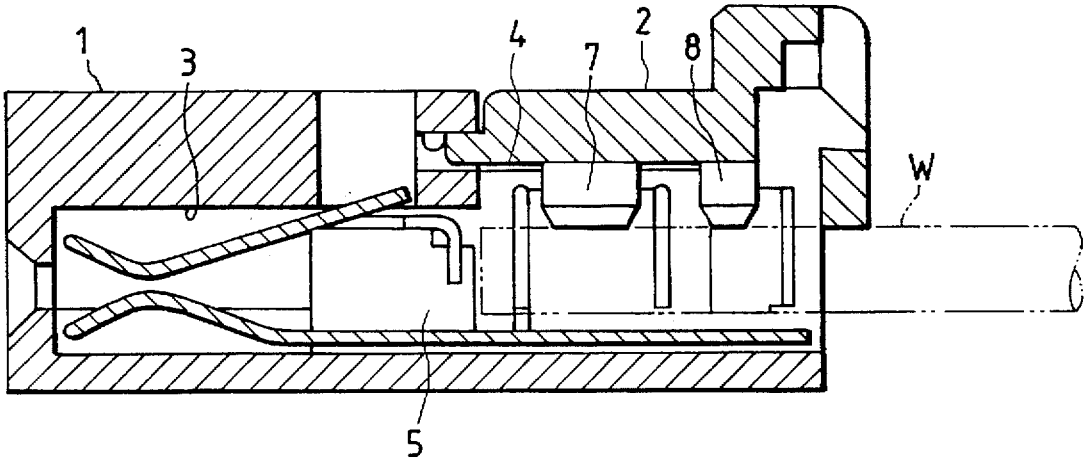
FIG. 6 PRIOR ART

FIGS. 1 and 2 are a perspective view, and a sectional view, showing a press-contact type connector, the embodiment of the invention, in which covers are not engaged with a connector housing. FIG. 3. is a sectional view showing the press-contact type connector in which the covers have been engaged with the connector housing. FIG. 4 is an enlarged diagram showing essential components of the press-contact type connector which has been assembled.

As shown in FIGS. 1 and 2, the press-contact type connector comprises a connector housing 11, an upper cover 12, and a lower cover 13. The connector housing 11 has an upper and lower chamber partition wall 11*a* at the middle as viewed in the vertical direction; that is, a number of terminal accommodating chambers 15 are provided on each of the upper and lower sides of the partition wall 11*a*. The terminal accommodating chamber 15 are arranged side by side (in a line), and they are separated from one another by lateral partition walls (not shown). The front ends of the terminal accommodating chambers 15 are communicated with outside through terminal inserting holes 11*c* which are formed in the front wall 11*b* of the connector housing 11 for insertion of the mating connector terminals, while the rear ends are fully opened. The upper surfaces of the rear portions of the upper terminal accommodating chambers 15, and the lower surfaces of the rear portions of the lower terminal accommodating chambers 15 are opened outside through openings 16 which are formed in the rear halves of the upper and lower walls.

Each of the press-contact terminals 25 accommodated in the connector housing has an electrical contact section (not referred by number) at the front end which is engaged with the mating connector terminal, and a wire press-contact section 26 at the rear end. As shown in FIG. 4, each wire press contact section 26 has front and rear press-contact slots 26*b* (each being made up of a pair of press-contact edges) between both side walls 26*a* which are electrically connected to the conductor of a wire W1 (W2) merely by pushing the wire down into the press-contact slots.

The upper cover 12 and the lower cover 13 are to close the above-described openings 16, and are integrated with connector housing 11 by means of flexible bands 17 whose first ends 17*a* are coupled to front end of the opening 16. The covers 12 and 13, and the connector housing 11 have locking means 21 and 22 which, when the covers 12 and 13 are engaged with the connector housing 11, lock the former and the latter to each other.

The flexible bands are arranged on both sides of each of the covers 12 and 13, and are each in the form of a narrow belt. At the rear end portions of the inner surfaces of the covers 12 and 13, locking protrusions 18 are provided which are to prevent the backward movement of the press contact terminals 25, and the remaining second ends 17*b* of the flexible bands 17 are coupled to the locking protrusions 18.

The first ends 17*a* of the flexible bands 17 are connected forwardly to the front ends of the openings 16 of the connector housing 11, and the second ends 17*b* are connected backwardly to the locking protrusions 18 of the covers 12 and 13. The length of each of the flexible bands 17 when extended is longer than the straight distance between both coupling sections (17*a* and 17*b*) which is obtained when the covers 12 and 13 are engaged with the connector housing 11. When covers are engaged with the connector housing, the middle of the each of the flexible bands 17 as viewed in the direction of length is bent (deformed) as indicated at 17*c*. Hence, the bent portion 17*c* presses the wire W1 (W2) in the direction of press contact (to the inner part of the press contact slot) which has been press-connected to the press contact terminal 25.

The press-contact type connector of the invention is assembled as follows: First, the press-contact terminals 25 are set in the terminal accommodating chambers 15 of the connector housing 11, and the wires W1 (W2) are connected through the openings 16 to the press-contact terminals 25 (cf. FIG. 4). Next, as shown in FIG. 3, the covers 12 and 13 are parallel-moved backwardly from the front standby positions to engage with the connector housing 11.

As a result, the middle portion of each of the flexible bands, through which the covers 12 and 13 are coupled to the connector housing 11, is bent (deformed). The bent portion 17*c* is moved in between the side walls 26*a* of the wire press-contact portion 26 of the press contact terminal 25, to press the wire W1 (W2) so that it may not be removed from the press contact slot 26*b*.

As was described above, each of the flexible bands 17 presses the respective wire while being elastically deformed. Hence, in the case of the thin wire W1 as shown in the part (a) of FIG. 4, and in the case of the heavy wire W2 as shown in the part (b) of FIG. 4, the wires W1 and W2 can be each pressed with a suitable force. Therefore, independently of the diameter of the wire, the wire can be prevented from being removed from the press contact slot 26*b*, and the covers 12 and 13 can be locked to the connector housing 11. Furthermore, under this condition, the locking protrusions 18 prevent the backward movement of the press-contact terminals 25; that is, the latter 25 are more positively held.

In the press-contact type connector of the present invention, the flexible pieces press the wires while being elastically deformed. Hence, independently of the diameter of wires, the wires can be positively pressed; that is, the removal of the wires from the press-contact slots can be prevented.

The press-contact type connector of the present invention has the following effects in addition to those of the connector of claim 1: The wires are pressed with the flexible bands which couples the cover to the connector housing. Hence, the resultant press-contact type connector is simple in construction.

With the press-contact type connector of the present invention, Since the front ends of the openings are coupled to the rear end portion of the cover with the flexible bands, the cover is engaged with the connector housing merely by parallel-moving the cover backwardly.

Since the locking protrusions are provided on the portion to which the second ends of the flexible bands are coupled, the engagement of the cover with the-connector housing prevents the backward movement of the press-contact terminals, thus holding the positions of the press-contact terminals correctly.

What is claimed is:

1. A press-contact type connector comprising:

a connector housing having a terminal accommodating chamber for accommodating a press-contact terminal, said terminal accommodating chamber having an opening for exposing a wire pressed against said press-contact terminal; and a cover engageable with said connector housing to close said opening; and a flexible band coupling said connector housing and said cover together, such that, when said cover is engaged with said connector housing, said flexible band elastically deforms and a portion of said flexible bands presses said wire.

2. A press-contact type connector as claimed in claim 1, wherein a length of said flexible band is so determined that, when said cover is engaged with said connector housing, a middle portion of said flexible band presses said wire.

3. A press-contact type connector as claimed in claim 2, wherein said opening is provided in a rear portion of said connector housing, a first end of said flexible band is coupled to a front end of said opening a second end of said flexible band is coupled to a rear end portion of said cover, and a length of said flexible band is greater than a distance between said first and said second ends of said flexible band when said cover is engaged with said connector housing.

4. A press-contact type connector as claimed in claim 3, further comprising:

a locking protrusion provided on an inner surface of said cover to prevent a removal movement of said press-contact terminal, said second end of said flexible band coupled to said locking protrusion.

5. A press-contact type connector as claimed in claim 1, further comprising a plurality of flexible bands.

6. A press-contact type connector as claimed in claim 5, further comprising:

a partition wall extending from said connector housing and separating an upper terminal accommodating chamber from a lower terminal accommodating chamber;

an upper cover and a lower cover for closing said openings of said upper and said lower terminal accommodating chambers, respectively; and an upper flexible band and a lower flexible band respectively coupling said connector housing and each of said upper and said lower covers together.

7. A press-contact type connector as claimed in claim 6, further comprising:

a plurality of upper flexible bands; and a plurality of lower flexible bands.

* * * * *